US006220266B1

(12) United States Patent
Hennessy

(10) Patent No.: US 6,220,266 B1
(45) **Date of Patent: *Apr. 24, 2001**

(54) PLUMBING INSTALLATION

(76) Inventor: Frank J. Hennessy, 100 Arboleda Ln., Carmel Valley, CA (US) 93924

( * ) Notice: Subject to any disclaimer, the term of this patent is extended or adjusted under 35 U.S.C. 154(b) by 0 days.

This patent is subject to a terminal disclaimer.

(21) Appl. No.: 09/483,509

(22) Filed: Jan. 14, 2000

Related U.S. Application Data

(63) Continuation of application No. 08/612,370, filed on Mar. 7, 1996, now Pat. No. 6,021,811, which is a continuation-in-part of application No. 08/511,141, filed on Aug. 4, 1995, now abandoned, which is a continuation of application No. 08/222,455, filed on Apr. 4, 1994, now abandoned.

(51) Int. Cl.[7] ..... F16K 11/20

(52) U.S. Cl. ..... 137/1; 137/606; 251/233; 251/250

(58) Field of Search ..... 137/606, 1; 251/233, 251/250

(56) References Cited

U.S. PATENT DOCUMENTS

| | | |
|---|---|---|
| 712,268 | 10/1902 | Dehekker . |
| 940,522 | 11/1909 | Falasca . |
| 1,392,449 | 10/1921 | Richards . |
| 1,475,051 | 11/1923 | Clifford . |
| 1,641,560 | 9/1927 | Whidden . |
| 1,821,260 | 9/1931 | Dobrick . |
| 2,631,613 | 3/1953 | Bergstrom . |
| 3,395,734 | 8/1968 | Spencer . |
| 3,635,252 | 1/1972 | Botnick . |
| 3,750,701 | 8/1973 | Botnick . |
| 3,863,810 | 2/1975 | Hanson . |
| 3,903,926 | 9/1975 | Kempler . |
| 3,973,594 | 8/1976 | Gustafsson et al. . |
| 4,074,697 | 2/1978 | Saether . |
| 4,429,712 | 2/1984 | MacDonald . |
| 4,815,703 | 3/1989 | Antoniello . |
| 5,070,906 | 12/1991 | Orlandi . |
| 5,487,408 | 1/1996 | Pokhis . |
| 6,021,811 * | 2/2000 | Hennessy ..... 137/606 |

FOREIGN PATENT DOCUMENTS

| | | |
|---|---|---|
| 1956161 | 11/1969 | (DE) . |
| 2408208 | 9/1975 | (DE) . |
| 2720047 | 11/1977 | (DE) . |

* cited by examiner

*Primary Examiner*—Stephen M. Hepperle
(74) *Attorney, Agent, or Firm*—Leo F. Costello

(57) ABSTRACT

A faucet assembly including dual handles whose position indicates, both tactilely and visually, the volume and exit temperature of the water flowing from hot and cold water valves to a faucet outlet. Such indication is achieved by the mounting and controlled movement of the handles, by their configuration and perimeter, by surface exposure, and by their individual connections to hot and cold water valves. The proximity of the handles and their controlled movement enables the handles to be manipulated simultaneously by a single hand of the user without pinching the fingers. The handles are mounted to conceal their mountings and their connections to the valves and are thus the only parts of the faucet assembly visible to a user thereby enhancing the appearance of the installation. Further, the faucet assembly reduces plumbing costs and is universally adaptable to both rotary and linear water valves in a wide variety of bath and kitchen installations.

20 Claims, 4 Drawing Sheets

PLUMBING INSTALLATION

CROSS-REFERENCE TO RELATED APPLICATION

This application is a continuation of my application Ser. No. 08/612,370, filed Mar. 7, 1996, now U.S. Pat. No. 6,021,811 which in turn is a continuation-in-part of my application Ser. No. 08/511,141, filed Aug. 4, 1995, now abandoned, which in turn is a continuation of my application Ser. No. 08/222,455, filed Apr. 4, 1994, now abandoned, all of said prior application being incorporated by reference herein.

FIELD OF THE INVENTION

The present invention pertains to a plumbing installation and more particularly to a faucet assembly for controlling fluid flow to a faucet outlet.

BACKGROUND

The faucet assemblies most commonly used today for controlling the flow of hot and cold water to a water basin, tub, or shower, or other washing facility are of three basic types, namely, (A) hot and cold water faucets each having a valve controlled by a handle, usually spaced on opposite sides of the water outlet and being respectively connected to hot and cold water lines, wherein the hot and cold water are mixed downstream of the valves prior to exiting from the outlet into the washing facility; (B) faucets having a single valve controlled by a single handle, usually mounted centrally of the water outlet, and being connected in tandem to hot and cold water lines, wherein the single valve regulates and mixes the flow as an integral function; and (C) faucets like type B except having two handles, normally differentiated in shape and movement, one for controlling volume and the other for controlling temperature.

In each type of faucet briefly described above, movement of the handle(s) to control water flow is a rotational movement. In type A, the dual handles pivot on spaced vertical axes; in type B, the single handle may be push-pull and rotational on a 45° axis or may rotate on a ball or universal joint; and in type C, the handles usually rotate about a common horizontal axis.

Dual handle faucets of type A are inexpensive, accurate, and are widely used. They are generally comprehensible but can be confusing to operate even if the handles are installed in the conventional way to rotate in opposite directions, namely, one clockwise and the other counterclockwise. Such confusion is compounded if the handles are intentionally or inadvertently installed to rotate in the same direction. Moreover, rotational directions in shower installations are sometimes the same and sometimes different so that confusion can result, especially if the handles are adjusted when the bather is facing away from the controls or has soap in the eyes. The conventional dual handle faucets described above require two hands to regulate water volume and temperature simultaneously. In addition, such dual handle faucets do not provide a good visual or tactile indication of water temperature.

Type B single handle faucets can of course be operated with one hand but lack good temperature indication. They employ complex and expensive mixing valves and are embodied in so many modes of operation as to be confusing to the unaccustomed user. More importantly, there is no sure way to regulate volume without affecting temperature, resulting in repeated readjustment, trial and error temperature control, and a corresponding waste of water and energy. Two handle mixing faucets of type C do allow limited single-handed operation and may have an inscribed temperature scale, but they are as complex and expensive as single handle faucets and are more difficult to operate.

In addition to the foregoing, other types of dual-handle faucets that can be operated with one hand have been disclosed, although they are not known to be in common use. An example is in the U.S. Patent to Kempler U.S. Pat. No. 3,903,926. Such faucets lack good temperature indication and have other drawbacks, such as complex internal mixing valves; unitized construction wherein handles, valves and spouts are integrated in a single housing; integral spouts; and surface mounted valve housings. These faucets reveal a clear intent to apply solely to lavatories and solely to surface-mounted conditions requiring finished faucet castings. Moreover, these known faucets utilize pivoting handles requiring close coupling of valve stems with the pivoting mechanism in order to restrict the required arcuate travel of the handles, thereby preventing concealment of valves below surfaces of varying dimensions.

Pivoting handles have the additional drawback of being difficult or impossible to operate by persons with physical disabilities if the shape of the handle requires specific finger manipulation or a twisting motion. Handles moving linearly can be easily operated regardless of the shape of the handles.

A faucet with dual handles that do not pivot but move on linear paths is disclosed in the German Patent to Killias, No. 19 56 161, but this faucet has a complex mixing valve and, in addition, has all the disadvantages of the type C faucets noted above.

SUMMARY

A faucet assembly is provided including dual handles whose position indicates, both tactilely and visually, the volume and exit temperature of the water flowing from hot and cold water valves to a faucet outlet. Such indication is achieved by the mounting and controlled movement of the handles, by their configuration and perimeter, by surface exposure, and by their individual connections to hot and cold water valves. In addition, the proximity of the handles and their controlled movement enables the handles to be manipulated simultaneously by a single hand of the user without pinching the fingers. The handles are mounted to conceal their mountings and their connections to the valves and are thus the only parts of the faucet assembly visible to a user thereby enhancing the appearance of the installation. Further, the faucet assembly reduces plumbing costs and is universally adaptable to both rotary and linear water valves in a wide variety of bath and kitchen installations.

An object of the present invention is to indicate, both tactilely and visually, the exit temperature and volume of water exiting from a faucet outlet by the relative positions of faucet handles.

Another object is to indicate the temperature of water exiting from a faucet outlet by various characteristics of dual faucet handles, such as their contour and exposure of a certain surface thereof.

An additional object is to indicate the temperature of water exiting from a faucet outlet by the degree of overlap of a pair of faucet handles as the handles are moved to open and close hot and cold water valves.

A further object is to enable conjoint adjustment of the volume and/or temperature of water exiting from a faucet outlet.

Another object is to enable the simultaneous adjustment of dual faucet handles with one hand of the user.

Still another object is to provide faucet handles with shapes which facilitate their linear conjoint movement by a single hand of a user.

Yet another object is to provide faucet handles which control the volume and temperature of water flowing from a faucet outlet by linear, sliding, translational movement of the handles, instead of rotary movement thereof.

An additional object is to provide an easily comprehensible association between sliding hot and cold water faucet handles and hot and cold water valves so as to facilitate control of the exit temperature and volume of the water exiting from an outlet.

A further object is to provide faucet handles that facilitate use by the physically impaired.

A still further object is to provide a plumbing installation for sinks, showers, tubs, and other washing facilities where only the faucet handles of a faucet assembly are mounted on and visible from the countertop, wall, deck, or other mounting surface.

Another object is to conceal valves and other mechanism associated with a faucet assembly for a washing facility thereby to improve the aesthetic effects and cleanability.

An additional object is to reduce the cost related to the manufacturing, finishing and distribution of a variety of finished faucet castings involving decorative valve and spout housings.

Another object is to facilitate cleaning and other maintenance around a washing facility by removing all but the handles of a faucet assembly from the countertop, wall, deck, or other mounting surface of the washing facility.

These and other objects will become apparent upon reference to the following drawings, description and appended claims.

DETAILED DESCRIPTION

Figure 1:
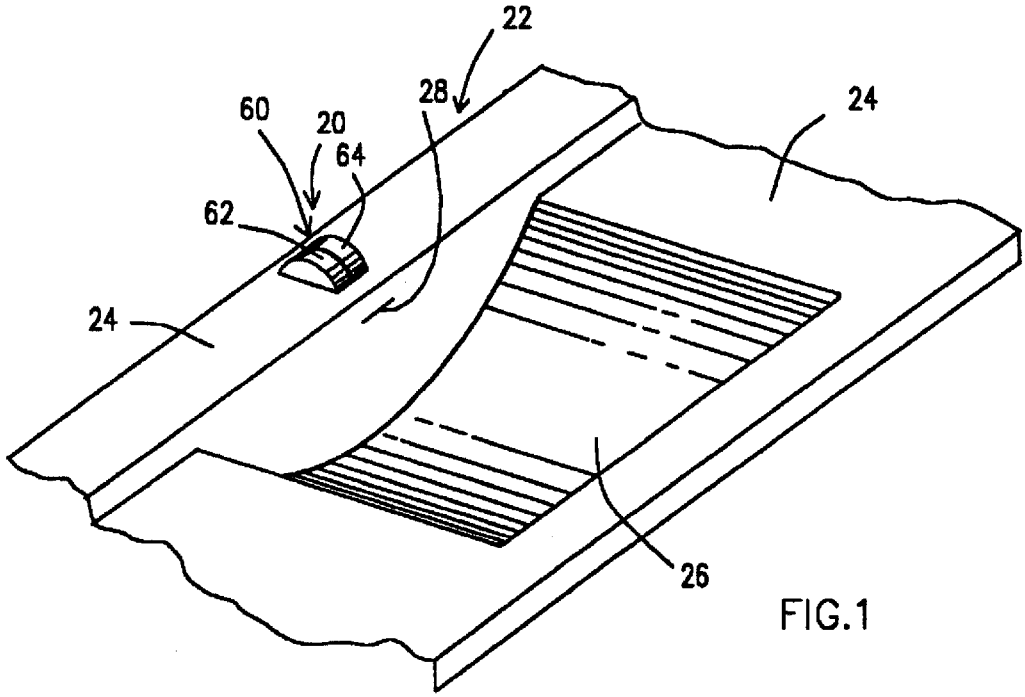
FIG. 1 is an isometric view of a plumbing installation showing a countertop, wash basin, faucet outlet, and a handle body composed of dual faucet handles in accordance with the present invention, with the handles shown in directly opposing relation to each other.
Figure 2:
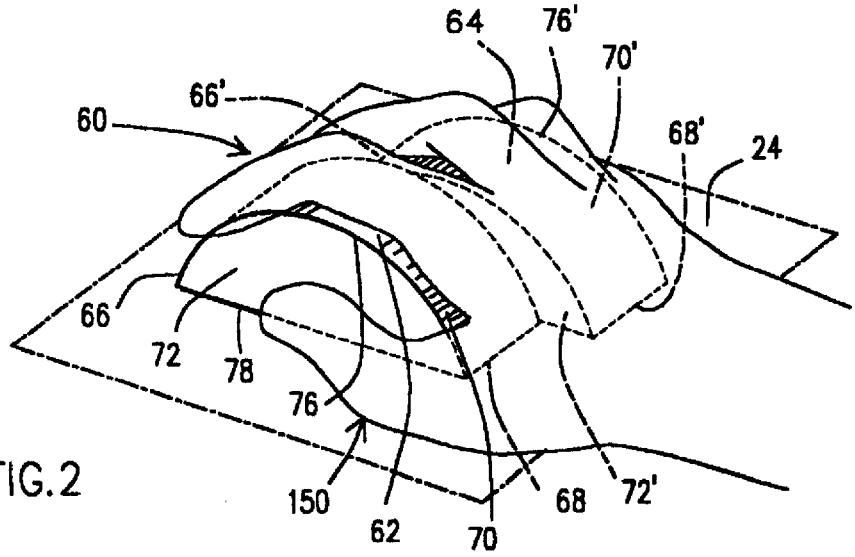
FIG. 2 is an isometric view of the dual handles showing a hand of a user in phantom over the handles to illustrate how the size, shape and proximity of the handles are adapted to facilitate control by a single hand of the user, with the right or cold water handle shown rearwardly of the left or hot water handle.
Figure 3:
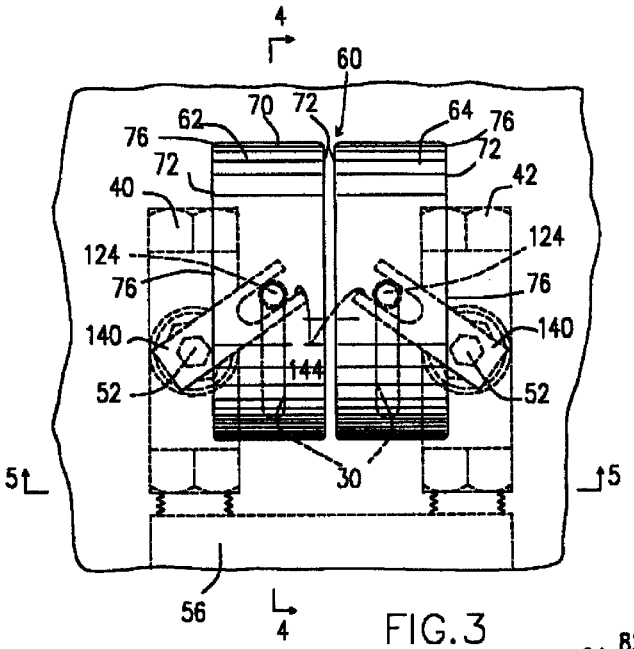
FIG. 3 is an enlarged fragmentary plan view of the plumbing installation of FIG. 1 illustrating the faucet handles connected to hot and cold water valves by linkages under the countertop and thus shown in dashed lines.
Figure 4:
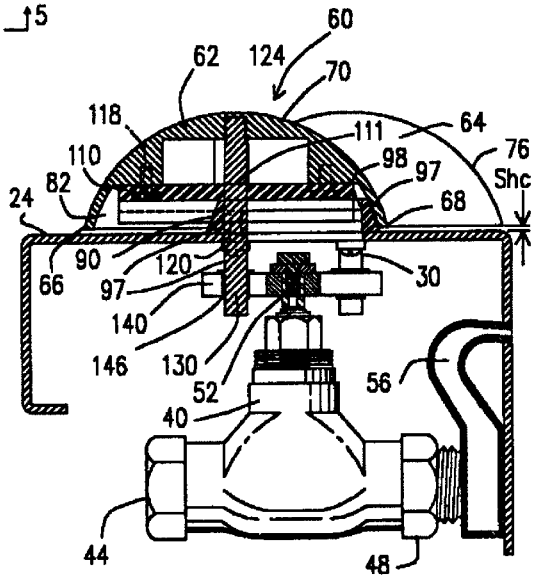
FIG. 4 is a vertical section taken along line 4—4 in FIG. 3 but showing the right or cold water handle offset from the left or hot water handle.

The faucet assembly of the present invention is illustrated in FIGS. 1–7 and is identified by the numeral 20. The subject faucet assembly is shown in a plumbing installation 22 for a bathroom vanity which includes a horizontal countertop or support surface 24, a basin or sink 26, and a faucet outlet 28. As best shown in FIGS. 3 and 4, the countertop has a pair of spaced parallel, side-by-side slots 30 extending therethrough for a purpose to be described. As the description proceeds, it will be understood that the subject faucet assembly can be used with an integral countertop/basin as shown; a separate countertop and basin; a bathtub, shower, or kitchen installation; or other plumbing installations where the features of the present invention may be advantageously employed. Although the embodiment described is for a countertop or support surface that is horizontal and the language used below has reference to such an orientation, it will be understood that the principles of the present invention are not limited to any particular orientation. For example, if used in a shower installation, the support surface would be vertical rather than horizontal, and the orientation of all of the parts would be described according to that reference.

Figure 5:
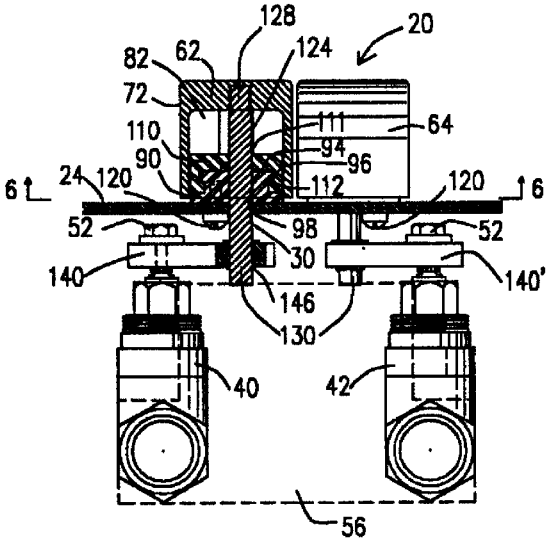
FIG. 5 is a vertical section taken generally along line 5—5 of FIG. 3 but showing the left or hot water handle and associated parts in section.
Figure 6:
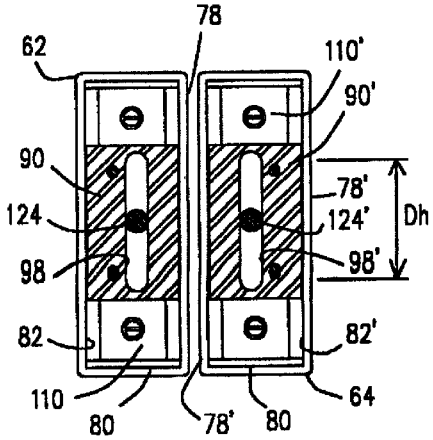
FIG. 6 is a horizontal section taken on line 6—6 in FIG. 5 and looking at the underside of the handles.

The plumbing installation 22 also includes hot and cold water valves 40 and 42 (FIGS. 3–5) mounted in spaced relation to each other under the countertop 24. These valves are mounted so as to be respectively located just outwardly of the slots 30 (FIG. 5). Since the valves are typically identical, the parts of only the hot water valve (i.e., the left valve as seen in FIGS. 1, 3 and 5) are specifically described. If the description requires specific reference to parts of the cold water valve, such parts will be referred to by the same number as the parts of the hot water valve, but the number will be primed. Thus, the hot water valve has an inlet 44, an outlet 48, and a valve stem 52 extending toward the countertop outwardly of its adjacent slot. The valves are of the rotary type so that when the stems are rotated through ninety degrees, the valves are moved between their open and closed positions. A manifold 56 is mounted under the countertop 24 and has connections to the outlets of the valves and to the faucet outlet 28.

The faucet assembly 20 includes a handle body 60 (FIGS. 1–7) which, when attached to the countertop 24, and in the condition seen in FIG. 1, appears as a single unitary object virtually resting on the countertop. In fact, however, the handle body is separable into dual, bi-symmetrical faucet handles 62 and 64 that are mounted in very closely spaced relation to each other and to the countertop. The handles are elongated blocks which in the preferred embodiment are of cast metal, but can be manufactured by other methods, such as stamping, and can be made of other materials, such as plastic or stone with minor alterations. In the preferred embodiment shown and described, the handles are arcuate or arch-shaped in side elevation (FIG. 4) and rectangular in plan view (FIGS. 3 and 6), and more particularly, are preferably approximately semi-cylindrical.

The faucet handles 62 and 64 (FIGS. 1–7) are thus duplicates of one another so that they are of uniform size and shape. Likewise, the parts of the faucet assembly associated with each handle are identical and are, moreover, completely concealed. As with the valves 40 and 42, therefore, only the hot water handle 62 and its associated parts will be described in detail. Where important for understanding, a reference numeral without a prime applies to the left or hot water handle 62 (as seen in FIGS. 1 and 2) or associated part, and a reference numeral with a prime applies to the right or cold water handle 64 or associated part. It will of course be understood that the invention is not limited to location of the hot water valve on the left and the cold water valve on the right, although this is a conventional orientation.

Referring then only to the hot water handle 62, it includes a lower front edge 66 (FIG. 4), a lower rear edge 68, a back surface 70, side surfaces 72 (FIG. 3), upper side edges 76, lower side edges 78 (FIG. 6), and an undersurface 80. The handle has a downwardly opening internal rectangular recess 82 that is outlined by the lower edges and therefore occupies nearly the full length and width of the handle while extending nearly half-way up into the handle.

A track 90 (FIGS. 4–6) is provided for the hot water handle 62 and is preferably made of a suitable plastic such as nylon or Delrin and, more particularly, is preferably of injection-molded nylon. Several features of the track are to be noted. It is I-shaped in transverse cross-section and thus includes an elongated upper horizontal rail 94 providing laterally extending tongues or splines 96. It has opposite ends 97, which are upwardly convergent or beveled on the outside, and an elongated longitudinal central passageway 98, which extends vertically through the track. The track is therefore like a frame that circumscribes the passageway. The track is less than one-half the length of the recess 82 in the handle, and thus of the handle itself, and has a maximum outside width equal to the width of the recess for assembly with the handle as described below. Also, the length and width of the passageway are slightly less than the length and width of the slot, for a purpose to be described.

An elongated slide 110 (FIGS. 4–6) for the hot water handle 62 is also provided and is preferably made of aluminum or a suitable plastic such as nylon or Delrin, and more particularly, is preferably extruded. It is rectangular in plan view (FIG. 6), with a central vertical bore 111 extending therethrough, and is C-shaped in transverse cross-section (FIG. 5), with a pair of longitudinal grooves 112 for assembly with the track 90 as described below. Moreover, the slide has a width that is the same as the width of the recess 82 in the handle and slightly greater than the outside width of the track 90. In addition, it has a length slightly less than the length of the recess but greater than the length of the track.

The track 90 and slide 110 (FIGS. 4–6) are assembled by inserting the track in the slide with the grooves 112 slideably receiving and interlocking with the tongues 96, it being noted that the bore 111 is thereby aligned with the passageway 98. Because of the described structural association and the materials used, the tongue and groove interconnection provides a low coefficient of friction and insures a smooth and quiet sliding action. The assembled track and slide are then inserted into the recess 82 of the handle 62, and the slide is secured to the handle by screws 118 which extend into the handle through holes countersunk in the slide, or by other suitable fasteners or fastening methods.

Next, the handle 62 (FIGS. 4 and 5) is positioned on the countertop 24 with the track 90 placed over the slot 30 so that the sides of the passageway 98 are aligned with the side edges of the slot (FIG. 5) and the ends 97 of the track slightly overlap the ends of the slot (FIG. 4). The track is then secured in fluid-tight engagement to the countertop by screws or other suitable fasteners, which are passed upwardly from underneath the countertop into the track.

In this manner, the track 90 and slide 110 mount the handle 60 on the countertop 24 (FIGS. 1, and 3–5) so that the handle completely covers and conceals the slot 30, the track and the slide, that is, all of its associated mounting parts. It is important to note that the track, especially because it is preferably made of a suitable plastic, serves as a circumferential seal around the slot against passage of water between the countertop and the track. Also, the skirt of the handle that surrounds the recess 82 extends down and slightly overlaps the track with the undersurface 80 in closely spaced opposed relation to the countertop. The side surfaces 72 of the handle are perpendicular to the countertop, and the back surface 70 faces away from the countertop.

A vertical hot water connecting or drive rod or shaft 124 (FIG. 4–60 has an upper end 128 connected internally and centrally to the upper wall of the hot water handle 62 by threads or by other suitable means. In the illustrated embodiment, the rod is thus equidistantly spaced from the side surfaces 72 and from the front and rear edges 66 and 68. The rod extends generally radially of the handle through the bore 111 of the slide 110, the passageway 98 in the track 90, through the slot 30 in the countertop 24, and has a lower end 130 projecting beneath the countertop. This rod is preferably connected to the handle prior to assembly with the track 90 and slide 110, but it is possible to insert it after such assembly.

The hot water handle 62 (FIGS. 1–7) is thus mounted on the countertop 24 to move only along the linear path provided by the track assembly 90/110. It cannot move vertically or laterally, and thus cannot be lifted or rotated. The handle is constrained to slide, and thus with translational movement, between first and second positions at opposite ends 97 of the track 90. With reference to FIG. 4, the handle can be moved forwardly (to the left) to a forwardmost limiting position where the connecting rod 124 engages the forward end of the track and the rearward end of the handle engages the rearward end of the track.

The handle 62 (FIG. 4) can also be moved rearwardly (to the right) to a rearward position where the connecting rod 124 engages the rearward end of the track and the forward end of the handle engages the forward end of the track. Insofar as the handle and rod, per se, are concerned, such engagement does limit the travel of the handle, but this is not the rearwardmost limiting position of the handle in the operation of the faucet assembly 20. Instead, when the handle 62 is connected to the hot water valve 40, as described below, closing of the valve limits rearward travel of the handle before the rod engages the track and determines the rearwardmost limiting position of the handle. Because the passageway is slightly shorter than the slot, the rod is assured of engaging the track instead of the slot to insure quiet and smooth movement and contact of metal against plastic instead of the countertop 24 which is typically a harder material. Also, the outside bevels on the ends of the track mate in a complementary fashion with the skirt of the handle, again with plastic being one of the contacting surfaces.

In addition to the advantages noted above, there is another important advantage of the described mounting of the handle 62 on the countertop 24 by the track 90 and slide 110 assembly. That is, the slide and track provide a cantilever mounting for the handle which is best illustrated in FIG. 4. Thus, when the handle is in either extreme limited position, and as it moves toward such position, the handle and slide are cantilevered on the track. In this way the handle maintains its level plane without any weakness in its support.

The cold water handle 64 (FIGS. 3–6) and its associated track 90' and slide 110' (FIG. 6) are, as above stated, identical with the hot water handle 62 and associated track 90 and slide 110 and are assembled and secured to the countertop 24 over the right slot 30 in exactly the same manner as the hot water handle is secured over the left slot.

Figure 7A:
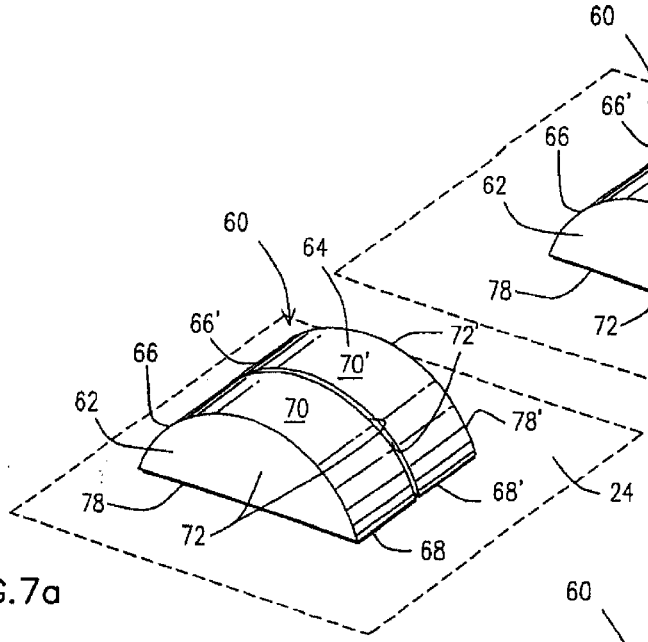
FIGS. 7 *a, b, c, d*, and *e* are isometric views of the dual handle faucets shown in various operating positions on the countertop which is indicated in phantom outline.
Figure 7B:
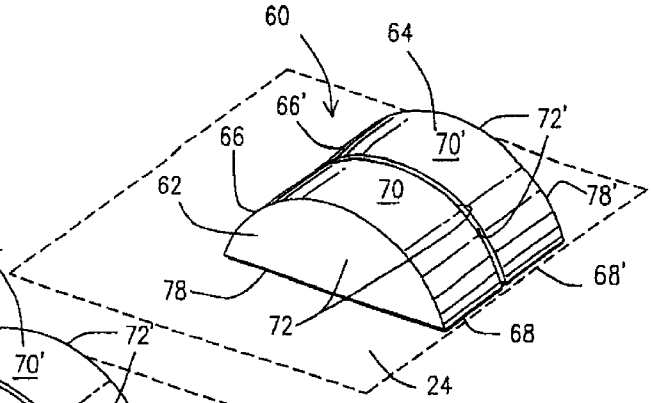
Figure 7C:
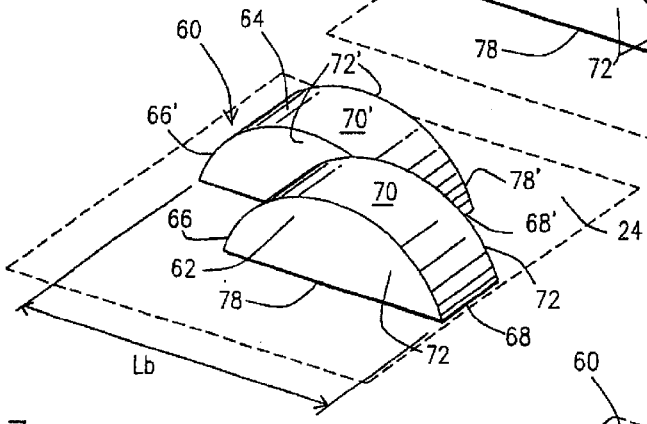
Figure 7D:
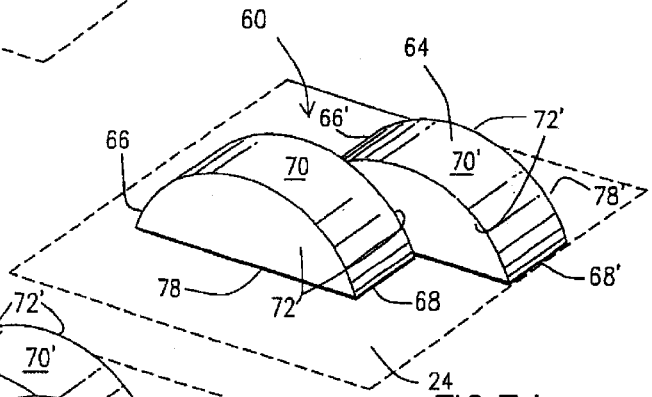
Figure 7E:
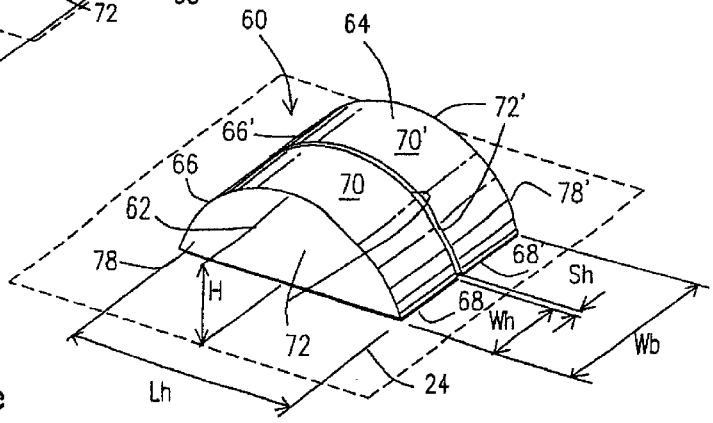
Figure 8:
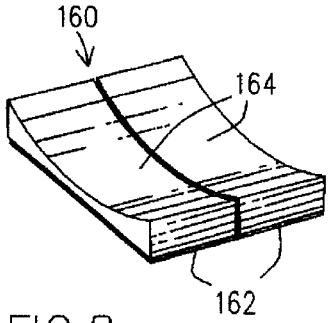
FIGS. 8, 9, and 10 are isometric views of different embodiments of the faucet handles.

The handles 62 and 64 (FIGS. 1–7) are thus mounted in juxtaposed relation and virtually in contact with just enough clearance to allow their relative sliding or gliding movement without touching. The handles always have some degree of overlap, either a fully overlapping, confronting relationship at any place along their paths, as shown in FIGS. 1; 3; 6; and 7*a, b*, and *e*; or an offset, partially overlapping relationship at various positions along the paths, as shown in FIGS. 2, 4, and 8. As above indicated, they are mounted so that they cannot be lifted, twisted or rotated, or moved laterally, leaving only the intended linear motion as the intuitive mode of operation. The handles can of course be moved along their linear paths independently of each other or at the same time. Because of their size, shape and contiguous mounting, however, it is significant to the present invention that the handles can be moved simultaneously or conjointly by a single hand of the user, as illustrated in FIG. 2, to control the valves 40 and 42, and without pinching the fingers.

A hot water lever 140 (FIGS. 3, 4 and 5), resembling a tuning fork, is attached to the hot water valve stem 52, extends radially therefrom in the general direction of the cold water valve 42, and is bifurcated to provide an endwardly opening notch 144 in alignment with the connecting rod 124 of the hot water handle 62. This connecting rod is slideably received in the notch, and a bushing 146 is preferably fitted around the rod to facilitate such slideable movement. Therefore, as the hot water handle is slid along its track 90, its connecting rod swings the hot water lever along an arcuate path thereby to pivot the hot water valve stem and rotate the hot water valve 40 between fully open and fully closed positions. The connecting rod moves in and out within the notch of the lever with nearly constant linear force since the lever arm length increases at the distal end of the lever arc where inertia and angular resistance are the greatest. The cold water handle 64 is connected to the cold water valve 42 by a cold water lever 140' in exactly the same way as described for the hot water handle and hot water valve.

The associated connecting rods 124, 124' and levers 140, 140' (FIGS. 3 and 5) are hereinafter sometimes referred to as a coupling or linkage interconnecting the handle 62 and its valve 40 and translating linear movement of the handle and rod into rotary movement of the valve stem 52 and valve. It will be understood that, although rotary valves are shown and described and are more typically used, it will be understood that linear valves, not shown, could be employed and that the connecting rods could readily shift valve stems of linear valves between their open and close positions.

The foregoing description identifies the parts of the subject faucet assembly 20, but prior to providing a more specific description of the operation of the faucet assembly, further identification or characterization of portions of the handle body 60 and its dual handles 62 and 64 will help in defining the relationship of the handles during such operation. In FIG. 2 and FIG. 7*a*, for example, it will be noted that the front edges 66 and 66', the lower outside edges 78 and 78', and the rear edges 68 and 68', define a circumferential edge, perimeter, or periphery of the handle body. As long as the two handles are in exactly opposed congruent relationship, as shown in FIGS. 7*a*, 7*b*, and 7*e*, this circumferential edge or perimeter remains of the same length, referred to herein as the minimum length of the circumferential edge. However, when the handles are moved into an offsetting relationship, as shown in FIGS. 7*c* and 7*d*, this circumferential edge is defined not only by the edges referred to above, but also by the lower inside edges 78 and 78'. In these offsetting positions, therefore, the length of the circumferential edge is greater than said minimum length.

It will also be observed from FIGS. 2 and 7 that the handle body 60 has a certain shape, contour or configuration, which in the preferred embodiment is basically an arch-shape when the handles 62 and 64 are in their directly confronting or congruent positions, as in FIGS. 7*a, b*, and *e* but is of a different shape when the handles are offset, as in FIGS. 2 and 7*c* and *d*. Having in mind these concepts of a varying circumference and a varying contour, a more detailed description of the operation of the faucet assembly 20 is now set forth.

OPERATION OF THE PREFERRED EMBODIMENT

The operation of the faucet assembly 20 of the present invention is best described with reference to FIGS. 2 and 7, remembering that the left handle 62 is coupled to the hot water valve 40, and the right handle 64 is coupled to the cold water valve 42. When the handles are in their rearwardmost limiting positions as shown in FIG. 7*b*, both the hot and cold water valves are completely closed. When the handles are in their forwardmost limiting positions, as shown in FIGS. 7*a*, the valves 40 and 42 are in their fully opened positions. Intermediate positions of the handles of course cause the valves to be partially opened or closed.

As shown in FIG. 7*d*, when the hot water handle 62 is in its forwardmost position and the cold water handle 64 is in its rearwardmost position, the hot water valve 40 is fully opened and the cold water valve 42 is fully closed. Conversely, when the hot water handle is in its rearwardmost position and the cold water handle is in its forward most position, as shown in FIG. 7*c*, the hot water valve is fully closed and the cold water valve is fully opened. FIG. 7*e* shows the handles in the positions where the hot and cold water valves are partially opened or partially closed.

As shown in FIG. 2, the dual faucet handles 62 and 64 are easily conjointly manipulated by a single hand 150 of the user. Normally the wrist is placed on the countertop 24, or other mounting surface, so that the fingers overlap the handle body 60, or stated otherwise, the handle body is fitted within the grasp of the user's hand. By maintaining the wrist in a generally stationary position on the countertop, the handles are manipulated with a palming motion or by using the finger tips to pull or push the handles, with perhaps a slight twisting of the wrist. As above noted, an important feature of the invention is that the shape of the handles, their constraint to an overlapping relationship, and their very close spacing, prevents pinching of the fingers during such manipulation by the hand.

It is very significant to the present invention that the relationship of the handles 62 and 64 to each other and to the countertop 24 or other mounting surface provides an indication to the user, both visually and tactilely, of the net flow or volume and the temperature of the water exiting from the faucet outlet 28. That is, when the perimeter 66/66', 78/78', and 68/68' of the handles is at its minimum, or stated otherwise, the overall contour of the handles is at a minimum and that of an arch, as in FIGS. 7*a, b*, and *e*, the handles indicate that both valves are equally opened or closed and, if opened, an equal amount of hot and cold water is flowing from the faucet outlet 28. If the left or hot water handle is forwardly of the right or cold water handle (FIG.7*c*), thereby increasing the length of the perimeter or circumferential edge and creating a different and larger contour in the handle body 60, this is an indication that more hot than cold water is flowing from the outlet. The converse is true if the right handle is forward of the left handle as in FIG. 7*d*. Also, as the handles are moved relative to each other, the degree of exposure of the inner side surfaces 72, from zero exposure to maximum exposure, also serves as an indicator of the relative positions of the hot and cold water valves and thus the mix and temperature of the water.

It will thus be understood that a user of the subject faucet assembly 20 (FIGS. 1 and 2) will soon become familiar both tactilely, visually, and instinctively with the length of the circumferential edge of the handle body 60, its contour, and/or the length of the exposed inner side surfaces 72, so that by looking at the handles, or more significantly, by merely feeling of them, the handles 62 and 64 provide the user with an indication of the net flow and temperature of the water. Such a feature is especially advantageous to one trying to adjust the water temperature while washing ones face and with the eyes closed or to a person with impaired vision.

Although the principles of the present invention are not limited to specific dimensions, the following sets forth detailed dimensions of the preferred embodiment of the handles 62 and 64 so as to illustrate an example of a dimensional relationship that can be achieved between the handle body and the normal hand size, the references for such dimensions being shown in FIGS. 7*c* and *e*, 4, and 6.

handles 62, 64, each: width $W_h$=1¼"; length$_h$=3⅜"; height H=1¼"

handle body 60: width $W_b$=2⁹⁄₁₆"; length $L_b$=3⅜" to 4¾";
height H=1¼"

clearance between handles: $C_h$=1⁄16"

spacing between handle and countertop 24: $S_{hc}$=1⁄16"

total travel distance, each handle: $D_h$=1⅜"

ALTERNATE EMBODIMENTS

Figure 9:
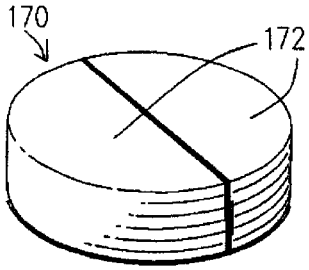
Figure 10:
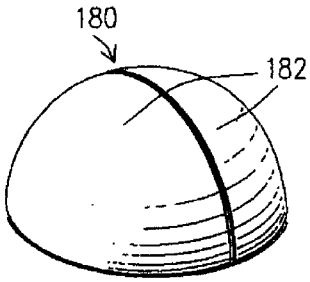

FIGS. 8, 9, and 10 show other embodiments of the handles 62 and 64. FIG. 8 shows a rectangular handle body 160 divided in half into duplicate handles 162 each having a sway back surface 164; FIG. 9 shows a circular handle body 170 again divided in half into semicircular handles 172, and FIG. 10 shows a hemi-spherical handle body 180 divided into a pair of quarter-spherical handles 182. Except for exterior shapes, these alternate handle bodies are constructed and operate like the handle body 60 described above. In addition, it will be apparent that even other shapes of handle bodies may be selected. As will be evident, the shape of the handle body has both a functional as well as an aesthetic purpose. As described above, the contour or configuration of the handle body is used as an indicator of water temperature and volume and thus has a utilitarian aspect. In addition, however, apart from its utility, each handle body shape does present a different appearance, so that one shape may be preferred with a wash basin, bathtub or showerhead. Thus, the handle body intentionally enhances, rather than clutters, the overall appearance of the fixture with which it is both functionally and formally associated.

Figure 11:
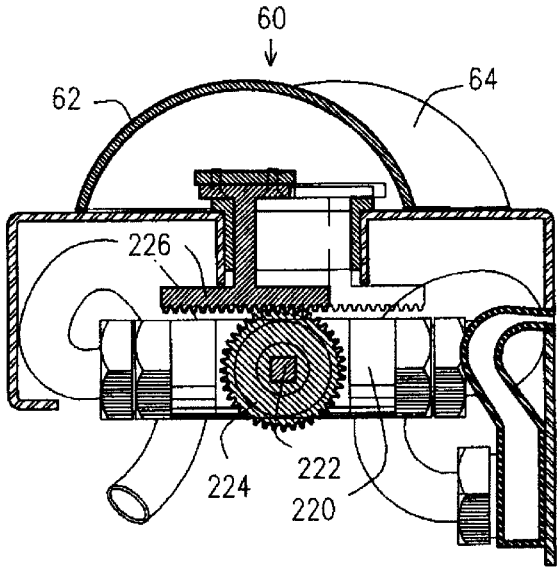
FIG. 11 is an exploded elevation of a plumbing installation but showing a second embodiment of the installation in a countertop or deck.

FIG. 11 shows an alternate mounting of the faucet assembly 20 for some installations. In this embodiment, the countertop 200 provides a larger opening 202, and a mounting plate 204 is attached under the countertop so as to position the valve stems 52 and 54 and the levers 140 and 142 within this opening. The handles 62 and 64 are mounted on a cover plate 206 which is fastened to the mounting surface of the countertop 200. In other respects, the interconnections and operation of the handles and valves are the same as described above. The exploded view in FIG. 11 serves to highlight the ease of installation and removal for servicing, cleaning or other maintenance. In the alternate embodiment, each handle 62 or 64 can be installed or removed simply by dropping the connecting rod 124 into, or lifting it up from, the bushing 146, as best seen in FIG. 11.

Figure 12:
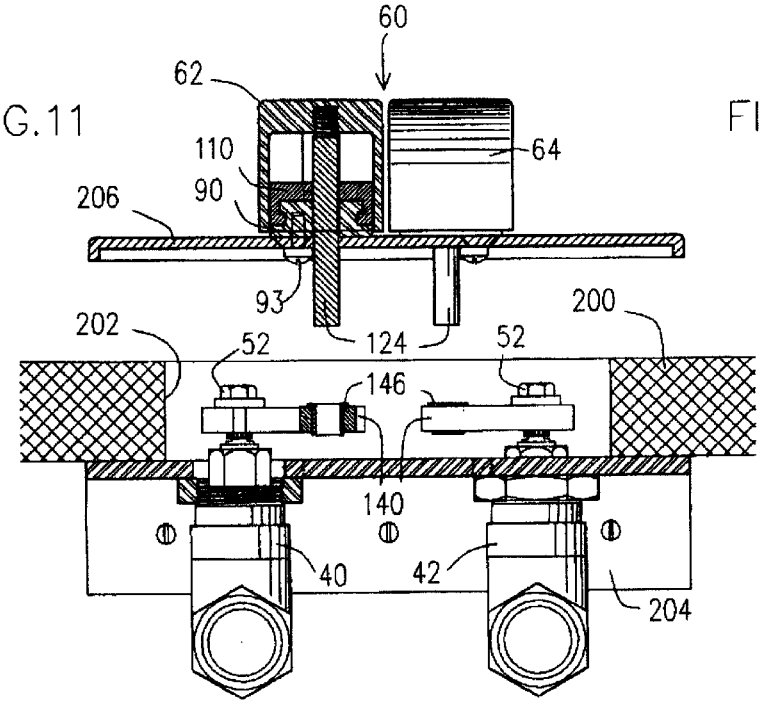
FIG. 12 is a fragmentary vertical section showing the dual handles of the present invention connected to hot and cold water valves by a second embodiment of a linkage different from that shown in FIGS. 3 through 6.

FIG. 12 shows a pair of rotary valves 220 which have their value stems 222 extending horizontally instead of vertically as in FIGS. 3–6. In this case, pinion gears, as 224, are secured to the valve stems and engage racks, as 226, attached to the lower ends 130 of the connecting rods 124. As the handles are moved back and forth on their tracks 90 and 92, the racks likewise move back and forth, and in engaging the pinion gears, rotate the valve stems and open and close their respective valves.

From the foregoing, it will be understood that a faucet assembly 20 is provided that includes dual handles 62 and 64 whose position indicates, both tactilely and visually, the volume and exit temperature of the water flowing from hot and cold water valves 40 and 42 to a faucet outlet 28. Such indication is achieved by the mounting and controlled movement of the handles, by their configuration, by their circumference, by the exposure of certain surfaces, and by their individual connections to the hot and cold water valves. In addition, the proximity of the handles and their controlled movement enables the handles to be manipulated simultaneously by a single hand of the user without pinching the fingers. The handles are also mounted to conceal their mountings and connections to the valves thereby enhancing the aesthetic effect of the installation. Furthermore, the faucet assembly is universally adaptable to both rotary and linear water valves in a wide variety of bath and kitchen installations.

Although preferred embodiments of the present invention have been shown and described, various modifications and substitutions may be made thereto without departing from the spirit and scope of the invention. Accordingly, it is to be understood that the present invention has been described by way of illustration and not limitation.

What is claimed is:

1. A faucet assembly associated with a support surface against which a user's hand may be supported, said assembly being capable of controlling valves that are movable between open and closed positions, comprising:

valve control handles respectively associated with the valves, the handles being mounted on the support surface for translational movement in the same or opposite directions and in juxtaposed relation along separate substantially parallel paths on the support surface into various positions including congruent juxtaposed positions and first and second positions at opposite ends of their respective paths and while portions of the handles always remain substantially in said juxtaposed relation, the handles together defining a joint handle body, each handle having front, rear and side lower edges closely adjacent to the support surface, the edges together defining a substantially continuous circumferential edge around the joint handle body in all positions of the handles, the clearance between the handles and between the lower edges of each handle and the support surface being just enough to allow their movement relative to each other and to the support surface without touching, the support surface being flat and extending outwardly from the rear and side lower edges of the handles, and the height of the handles off the support surface being greater than the thickness of the user's thumb, and the handles being connected to their respective valves so that upon movement of each handle between its first and second positions by a user's hand against said support surface engaging both handles, its valve is moved between its open and closed positions, whereby the positions of the handles relative to their respective paths and to each other in their juxtaposed relation indicates, by touch of the user's hand and by observation, the relative positions of the valves without using separate markings to indicate such positions.

2. The faucet assembly of claim 1 wherein the valves are hot water and cold water valves which deliver a mix of hot and cold water of varying temperature and volume to an outlet, wherein said handles are hot water and cold water handles respectively associated with the hot and cold water valves, wherein the handles are mounted for separate or conjoint movement back and forth along said paths between said first and second positions, wherein each of said handles has front and rear portions and opposed upstanding side surfaces that are concealed when the handles are in congruent juxtaposed positions but form exposed front and rear angularly related surfaces with the front and rear portions of the handles and with the support surface as the handles are moved relative to each other out of congruent juxtaposed position, and wherein the hot water and cold water handles are connected to the hot water and cold water valves, respectively, so that when each handle is in either of its first or second positions, its associated valve is either fully open or fully closed, wherein the handles can separately or conjointly adjust the volume and temperature of the water exiting from the outlet, said exposed angularly related surfaces being of sufficient areas to allow the user's fingers to fit thereagainst while the user's hand is supported on the support surface and thereby sense the positions of the handles and thus of the valves, whereby the juxtaposed relation of the handles and the exposed angularly related surfaces enable tactile or visual indication of the volume and temperature of the water exiting from the outlet.

3. The faucet assembly of claim 1, wherein said handles are elongated blocks of substantially uniform size and shape having longitudinal and transverse dimensions, wherein the handles are mounted on the support surface with said longitudinal dimensions disposed lengthwise of said paths, wherein the handles have flat underneath faces from the front edge to the rear edge and from one side edge to the other side edge and in opposed relation to the support surface and outer faces facing in directions different from the underneath faces, said outer faces being adapted to be engaged by said user's hand and fingers for moving the handles along said paths, and wherein said clearance is less than the thickness of a human finger whereby such shape, close spacing and said juxtaposed relationship avoids pinching of the user's hand or fingers as the handles are moved into their various positions.

4. The faucet assembly of claim 1, wherein said clearance is about 1/16".

5. The faucet assembly of claim 1, wherein the handles have outwardly directed smooth arcuate faces against which the fingers of the user's hand may conform when engaging the handles.

6. The faucet assembly of claim 5, wherein the faces are outwardly convex.

7. The faucet assembly of claim 5, wherein the faces are outwardly concave.

8. The faucet assembly of claim 5, wherein the handles have substantially the shape of segments of a cylinder.

9. The faucet assembly of claim 8, wherein the segments are side-by-side with the convex faces directed away from the support surface and their flat faces substantially parallel to each other and appearing to be substantially one partially cylindrical body when in said congruent juxtaposed positions.

10. The faucet assembly of claim 8, wherein the segments are side-by-side with their convex faces laterally directed and substantially forming a cylinder.

11. The faucet assembly of claim 5, wherein the handles are quarter segments of a sphere, side-by-side, and substantially form a hemisphere when in said congruent juxtaposed positions.

12. The faucet assembly of claim 1, wherein slot means are provided under the handles but not between the handles, said slot means opening through the support surface, and wherein said handles cover said slot means in marginally overlapping relation to the support surface in all of the positions of the handles.

13. A faucet assembly for a plumbing installation which includes an outlet and first and second fluid valves connected to the outlet and having various positions for adjusting the flow to the outlet, comprising:

a mounting surface, a dual handle body including separable first and second handles, the first and second handles being mounted on the mounting surface for sliding movement along substantially parallel paths into various positions including a directly opposed side-by-side position wherein the handles form a predetermined minimum contour for the handle body and positions offset from said opposed position wherein the handles form larger contours for the handle body, the surface extending outwardly from the handles beyond said contour, the handles being mounted in closely spaced relation to the mounting surface and in closely spaced relation transversely of said paths such that the clearance between the handles and between the handles and the mounting surface is only enough to allow such sliding movement without touching and such that in the directly opposed positions, they appear as virtually one body, stops on the handles and the mounting structure that interengage in said offset positions and limit movement of the handles longitudinally of the paths so that in all positions of the handles either said minimum contour or one of the larger contours is formed, and the first and second valves being separately movable into their various positions in response to said movement of the first and second handles so that the contour of the handle body is an indication of the relative positions of the valves.

14. The faucet assembly of claim 13, wherein the handles are substantially the same size and shape, wherein each handle has an outwardly directed arcuate face, and wherein when the handles form said minimum contour, said arcuate faces are substantially continuous and have a substantially common generatrix.

15. A method of opening and closing hot and cold water valves by hot and cold valve control handles that are mounted in juxtaposed relation on a substantially flat support surface for movement in the same or opposite forward and rearward directions along substantially parallel paths between first and second positions spaced along said paths, the handles being constrained at all times in their movement along said path to juxtaposed and overlapping relation to each other, the support surface being flat and extending outwardly at the sides and rear of the handles, the handles being mounted so close to the support surface that only enough clearance exists between the handles and the surface as to allow movement of the handles thereover without touching, said valves being movable between opening and closing directions in response to movement of the handles along these paths, comprising the steps of:

placing a user's hand on the support surface rearwardly of the handles and at the opposite sides thereof with the user's palm and fingers of such hand in overlying contact with both of the hot and cold valve control handles, and manipulating one or both of the handles back and forth between said opening and closing positions with said fingers while steadying the engagement of the fingers with the handles by maintaining the user's hand against said support surface and wherein the handles may remain under and within the user's hand as the handles are moved between said opening and closing positions.

16. The method of claim 15, wherein said manipulating step includes the steps of causing the user's fingers to move the hot water handle in a hot water valve opening direction, causing the user's fingers to move the hot water handle in a hot water valve closing direction, causing the user's fingers to move the cold water handle in a cold water valve opening direction, and/or causing the user's fingers to move the cold water handle in a cold water valve closing direction, wherein the positions of said handles relative to their respective paths and to each other determine both the net flow and exit temperature of water from the valves, and wherein said method includes the further step of sensing said net flow and exit temperatures by either the user's fingers touching the surfaces of the handles while the user's hand remains supported on the support surface and/or by visually observing the relative positions of the handles.

17. The method of claim 16, wherein said causing steps are performed independently of each other or are performed in such combination as to move the hot and cold water handles simultaneously in either closing directions or in opening directions.

18. The method of claim 15, including the further steps of:

sensing the relationship of the handles by touching the handles with the user's fingers while the user's hand remains supported on the support surface in any given position of handles thereby indicating the positions of the valves.

19. The method of claim 18, wherein the sensing step involves touching the angular-related surfaces of the juxtaposed handles in the various positions of the handles.

20. A plumbing installation which is associated with a mounting surface having a slot therein and which provides valving for controlling fluid flow to an outlet, comprising:

a track supported on the mounting surface over the slot, a valve control handle, and a slide attached to the handle, slidably engaging the track, and mounting the handle for movement along the track over the mounting surface and the slot therein, the slide and the handle being cantilevered on the track wherein the handle and the slide cantilever outwardly over the mounting surface in various positions of the handle and slide, and the handle being of a size and shape that covers and conceals the track and the slot while overlapping said mounting surface without exposing the track or the slot.

* * * * *